US007195119B2

(12) United States Patent
Lungo

(10) Patent No.: US 7,195,119 B2
(45) Date of Patent: Mar. 27, 2007

(54) PORTABLE TOOL CARRIER FOR STEP LADDERS

(76) Inventor: Philip M. Lungo, 5920 Park Ridge Rd., Loves Park, IL (US) 61115

( * ) Notice: Subject to any disclaimer, the term of this patent is extended or adjusted under 35 U.S.C. 154(b) by 0 days.

(21) Appl. No.: 10/054,448

(22) Filed: Jan. 18, 2002

(65) Prior Publication Data

US 2002/0092785 A1 Jul. 18, 2002

Related U.S. Application Data

(60) Provisional application No. 60/262,501, filed on Jan. 18, 2001.

(51) Int. Cl.
*B65D 85/28* (2006.01)

(52) U.S. Cl. ..... 206/373; 182/129

(58) Field of Classification Search ..... 206/372, 206/373, 349, 217; 182/107–109, 129; 248/210, 238; D25/68; 383/2, 39–40, 38, 383/104; 220/696, 697, 735–736, 751, 756, 220/759, 760, 771, 482; D7/514, 527, 507, D7/509; D32/53, 53.1; 215/395–396, 398–399
See application file for complete search history.

(56) References Cited

U.S. PATENT DOCUMENTS 1,284,579 A * 11/1918 Brown ..... 220/485
1,584,857 A * 5/1926 Hobbs ..... 215/395
2,051,060 A * 8/1936 Upthegrove ..... 248/210
2,517,757 A * 8/1950 Adlerstein ..... 312/3
3,229,947 A * 1/1966 White ..... 248/314
3,951,486 A * 4/1976 Tracy ..... 312/235.8
4,049,187 A * 9/1977 Florian ..... 206/519
4,726,446 A 2/1988 Perbix
4,854,466 A * 8/1989 Lane, Jr. ..... 220/23.83
D309,848 S * 8/1990 Sokolski et al. ..... D7/620
D317,206 S 5/1991 Cagle
5,097,975 A * 3/1992 Waterston et al. ..... 220/23.83
5,219,140 A * 6/1993 Spykerman ..... 248/311.2
5,220,744 A * 6/1993 Kendall ..... 248/218.4
D347,547 S * 6/1994 Heinrich ..... D7/533
5,437,502 A 8/1995 Warnick
D365,232 S * 12/1995 Briault ..... D6/513
5,603,405 A * 2/1997 Smith ..... 206/373
D379,288 S * 5/1997 Azar ..... D7/620
D380,276 S * 6/1997 Gaona et al. ..... D25/68
5,638,915 A 6/1997 Hardy
5,639,003 A 6/1997 Utzinger, II
5,647,453 A 7/1997 Cassells
5,749,437 A 5/1998 Weller
5,782,314 A 7/1998 Zeitler (Continued)

*Primary Examiner*—Shian T. Luong

(57) ABSTRACT

A tool carrier for a step ladder includes a top panel adapted to rest on the top step of the ladder, a skirt depending downwardly from the top panel and around the upper portion of the ladder, tool-receiving pockets provided on the skirt, and a handle connected to enable lifting and carrying the tool carrier from above. The skirt includes front, back and side panels associated with respective sides of the ladder and that establish a lower perimeter adapted to enable use as a free-standing tool carrier. The panels are preferably elastically connected to slip snugly around the upper portion of the ladder. Accessory tool holders are adapted to be slipped into snug pockets for holding larger-size tools and other articles not conveniently held in the pockets. A preferred panel-supporting frame structure assists in maintaining the shape of the skirt.

16 Claims, 11 Drawing Sheets

U.S. PATENT DOCUMENTS 5,782,360 A * 7/1998 Markson ..... 206/600
D397,229 S 8/1998 Winters
5,813,530 A 9/1998 Kornblatt
5,816,631 A * 10/1998 Kochan ..... 294/33
5,901,998 A 5/1999 Gallo
D410,551 S 6/1999 Guimont
5,971,101 A 10/1999 Taggart
5,971,200 A * 10/1999 Reynolds ..... 220/694
5,988,383 A * 11/1999 Armstrong ..... 206/373
D418,612 S * 1/2000 Deutsch ..... D25/68
6,076,700 A * 6/2000 Manges ..... 220/751
D427,771 S 7/2000 Trejo
6,138,963 A * 10/2000 Malvasio ..... 248/111
6,260,811 B1 * 7/2001 O'Neil ..... 248/311.2
6,328,158 B1 * 12/2001 Bisbal et al. ..... 206/223
D458,723 S * 6/2002 Malvasio ..... D32/53.1
6,398,065 B1 * 6/2002 Lewis ..... 220/737
6,536,590 B1 * 3/2003 Godshaw et al. ..... 206/373
6,564,941 B2 * 5/2003 Hedges ..... 206/373
D484,753 S * 1/2004 Giampavolo ..... D7/620

* cited by examiner

PORTABLE TOOL CARRIER FOR STEP LADDERS

CROSS-REFERENCES TO RELATED APPLICATIONS

This application claims the benefit of U.S. Provisional Patent Application Ser. No. 60/262,501 filed Jan. 18, 2001.

Statement Regarding Federally Sponsored Research or Development: not applicable.

Reference to microfiche appendix: not applicable.

BACKGROUND OF THE INVENTION

1. Field of Invention

The present invention relates generally to tool carriers suitable for use with conventional folding step ladders, and of the type having a top panel adapted to rest on the top step of a step ladder, a skirt depending downwardly from the top panel, and tool-receiving pockets provided on the skirt.

More particularly, the invention relates to a tool carrier of the above general type, but which is further adapted for use as a free-standing tool holder, and accessory tool holders adapted for use therewith to carry tools that are not conveniently held in pockets.

2. Description of Prior Art

When working on a step ladder, it is advantageous to have available within convenient reaching distance tools and other items that might be needed or useful for accomplishing the task at hand.

Having such tools available within reaching distance when on the ladder reduces the time needed to complete the task, by, for example, eliminating the need to repeatedly descend from the ladder, retrieve the tool or additional supplies, and then climb back up the ladder.

For example, if performing electrical work while on a step ladder, it is convenient to have wire connectors and electrical tape, various pliers, wire cutters and strippers, manual and/or power screwdrivers, a small power drill, and the like in a position that is within reaching distance while on the ladder. It is also convenient if such tools can be stored together between jobs and in anticipation of the next job.

Therefore, it is desirable to provide a tool carrier adapted for use on the top step of a step ladder and provided with tool-receiving pockets for ease of reaching the tools when on the ladder.

It is also desirable that such tool holders be adapted for ease of positioning onto and removal from the step ladder, particularly when pre-filled with tools. This enables the user to fill the tool holder such as from a selection of tools in a tool cabinet or at a work bench, and to then position holder with the desired tools onto the ladder.

It is further desirable that such tool holders be adapted for use as a free-standing tool holder. This provides for ease of filling the tool holder at the tool cabinet or work bench, and enables the tools to be easily carried to and used at another work site not on a ladder, and to be stored in the tool holder at the work bench or other desired storage location between uses.

It is still further desirable that such tool holders be adapted for holding relatively small tools, relatively large tools and tools of unusual and substantially different shapes. More particularly, it is desirable that the tool holder be capable of supporting such a variety of sizes and shapes with the use of, for example, a single set of pockets. In addition, it is desirable to hold such tools as are not conveniently held in pockets. This substantially enhances ease of providing for use of different tools such as may be required for different tasks.

By way of example, it would be desirable for the tool holder to be capable of carrying such diverse tools as a hammer, a portable electric screwdriver, a wide paint brush, large gutter nails, and small tacks at different times but in the same set of pockets. Such capability also reduces the need to provide multiple pockets of a wide variety of sizes and shapes, some of which may only be used at certain times for specific tools.

Accordingly, it is further desirable to provide an accessory tool holder adapted for holding a wide variety of tool sizes and shapes in a single set of pockets on the tool carrier.

One conventional method for keeping tools within reaching distance while working on a ladder is to wear a tool belt in which such tools are stored. However, use of tool belts presents certain obvious limitations and inconveniences. Among other things, tool belts can be relatively heavy when filled with tools, and they can be awkward when maneuvering on and off the ladder. In addition, some people are simply not comfortable wearing tool belts, and certain tasks require tools that are not conveniently held in tool belts.

Another method is to place the desired tools into a bucket, or other conventional free-standing tool holder, and set the bucket on the top step or the fold-out shelf of the step ladder, or to hang the bucket from an upper rung on the side or the ladder opposite the steps. However, use of such tool holders presents obvious dangers when positioned on a ladder, and such use is not recommended by ladder manufacturers. In attempt to reduce such dangers, certain prior tool holders adapted to set on the top step of a ladder are provided with hooks, straps or other fastener arrangements intended to secure the tool holder to the top step. Such arrangements are shown in Finster, U.S. Pat. No. 4,589,521; Hamilton, U.S. Pat. No. 4,653,713; Buckley, U.S. Pat. No. 5,727,649; Zeitler, U.S. Pat. No. 5,782,314; Kornblatt, U.S. Pat. No. 5,813,530; Gallo et al., U.S. Pat. No. 5,901,988; Gugel et al., U.S. Pat. No. 5,913,380; and Spadaro, U.S. Pat. No. 5,941,344.

Tool holders of the general type as the present invention include a top panel adapted to rest on the top step of the step ladder, a skirt depending downwardly from the top panel, and tool-receiving pockets on the skirt. Such arrangements reduce the dangers of the tool holder falling off the ladder by providing the skirt that generally surrounds surrounding the top of the ladder, and by their generally low profile with respect to the top step (i.e., by typically not including structure that extends substantially above the top panel).

Tool holders of this general type are shown in, for example, Cagle, U.S. Pat. Des. 317,206; Winters et al., U.S. Pat. Des. 397,229; Guimont et al., U.S. Pat. Des. 410,551; Trejo, U.S. Pat. Des. 427,771; Warnick et al., U.S. Pat. No. 5,437,502; Hardy, U.S. Pat. No. 5,638,915; Utzinger, III, U.S. Pat. No. 5,639,003; Cassells, U.S. Pat. No. 5,647,453; Weller, U.S. Pat. No. 5,749,437; and Taggart, U.S. Pat. No. 5,971,101.

However, all of these prior tool holders suffer from certain drawbacks and disadvantages with regard to the above-mentioned desirable characteristics of such tool holders.

For example, some of these prior tool holders must be secured into position on or snugly around the ladder with ties or straps that extend around the corners of the ladder and connect adjacent panels of the skirt. (See e.g., Cagle, Cassells, Guimont et al., Hardy and Taggart.) Such arrangements can be time consuming to attach to and remove from a ladder, and securing such arrangement pre-filled with tools can be extremely difficult.

Some of these prior tool holders lack means for ease of transporting a filled tool holder, or for ease of installation of a filled tool holder onto and removal from the ladder. (See e.g., Trejo, Warnick et al., Taggart, Guimont et al., Cassells, and Cagle.)

None of these patents discuss or recognize the desirability of a tool holder that is adapted for use both on a ladder and as free-standing unit such as on a work bench. Most of these prior arrangements are simply not capable of holding tools in a stable, free-standing position, because the skirt does not present a structure that is suitable for supporting the filled tool holder in a stable upright position on a horizontal surface, and the one or two that may be interpreted as capable of use in a free-standing mode suffer from one or more of the other disadvantages identified herein.

A few of these prior tool holders provide specially sized pockets for specific tools such as a portable drill, or straps for holding certain elongated tools such as a hammer or crow bar. However none of these tool holders are capable of alternately carrying a variety of different larger-size tools, or tools of substantially different sizes and shapes, in the same set of pockets.

Accordingly, there is a need for an improved tool carrier of the subject type that is suitable for use with and fits snugly onto the top of a step ladder, that is adapted for ease of positioning onto and removing from a ladder, that is adapted for use as a free-standing tool holder, that is adapted for ease of transporting the tools loaded therein, and that addresses the other drawbacks and disadvantages of prior tool carriers identified above.

SUMMARY OF THE INVENTION

The general aim of the present invention is to a provide new and improved portable tool carrier of the type having a top panel adapted to rest on the top step of a step ladder, a skirt depending downwardly from the top panel, and pockets carried on the skirt for storing tools on the top step of a step ladder, It is an objective of the invention to provide a tool carrier of the subject type that is further adapted for fitting snugly and securely when positioned onto the top of the ladder.

It is another objective of the invention to provide a tool carrier of the subject type that is further adapted for ease of slipping onto and off of the ladder, including when filled with tools.

It is another objective of the invention to provide a tool carrier of the subject type that is further adapted for ease of transporting and storage of tools when not in position on the ladder.

It is another objective of the invention to provide a tool carrier of the subject type that is further adapted for retaining its structural and tool carrying shape when filled with tools but not in position on the ladder.

It is another objective of the invention to provide a tool carrier of the subject type that is further adapted for use as a free-standing tool holder.

It is another objective of the invention to provide a tool carrier of the subject type that is further adapted for carrying a wide variety of sized and shaped tools, including tools that are generally not convenient or suitable to be carried in pockets.

It is another objective of the invention to provide an accessory tool holder that is adapted for use with a tool carrier of the subject type, and that is capable of holding a wide variety of sized and shaped tools, including tools that are generally not convenient or suitable to be carried in pockets.

It is another objective of the invention to provide an accessory tool holder of the subject type that is adapted to carry a wide variety of tools in the same set of pockets on the tool carrier.

These and other objectives and advantages of the invention will become more apparent from the following detailed description when taken in conjunction with the accompanying drawings.

Briefly, a tool carrier in accordance with the invention includes a top panel sized to rest on the top step of the step ladder, a skirt that depends downwardly from the top panel, to slip over and around the upper portion of the ladder, and pockets carried on the skirt for carry tools and other articles of potential use when working on the ladder.

The skirt includes front, back and side planar panels associated with, and shaped for conformance with, the front, back and sides of the upper portion of the ladder.

In accordance with one aspect of the invention, the skirt is preferably made with relatively stiff construction, and is provided with a lower perimeter, such as with lower perimeter edge portions at a constant distance from the top panel, adapted to alternately support the tool carrier and the tools therein in an upright position on a horizontal surface. These characteristics provide for ease of installation onto and removal from the ladder, for ease of transporting the tools therein when not positioned on the ladder, and enables use of the tool carrier as a free-standing unit at locations other than on a step ladder.

A handle device is connected to either the top panel or the skirt, into a position for grabbing from above the top panel. The handle provides further ease of raising and lowering the tool carrier and tools therein from and onto the top of the step ladder, and a horizontal surface, and of transporting the tool carrier and tools therebetween.

In accordance with another aspect of the invention, adjacent panels are preferably elastically connected, such as with elastic bands between adjacent edge portions, for expansion and contraction of the skirt as the skirt is positioned onto and removed from the top of the ladder. This unique expansion/contraction characteristic assists in providing a snug fit onto the upper portion of the step ladder, and in accommodating use on different sized ladders.

In accordance with yet another aspect of the invention, a frame or reinforcing structure is preferably provided, connected to at least either the top panel or the skirt, to provide structural stiffness to the tool carrier and particularly the skirt for purposes discussed above, and to establish the lower perimeter adapted for supporting the tool carrier as a free-standing unit, when the skirt panels are fabricated from less stiff materials. Accordingly, the frame structure assists in retaining the shape of the tool carrier, particularly when filled with tools.

In preferred embodiments, the frame structure is an expandable/contractable structure adapted for use with the elastically connected panel structure. In this instance, a preferred frame structure includes independent top, front, back and side frame members, connected to the respective panel, for independent elastic movement therewith. As a result, the expandable frame assists in retaining the shape of the tool carrier when filled with tools, and as the skirt expands and contracts during installation onto and removal from the ladder, as well as when positioned on a horizontal surface as a free-standing tool holder, and when being carried therebetween.

In accordance with still another aspect of the invention, an accessory tool holder is provided that includes a generally upwardly facing tool-supporting surface, an associated generally vertically extending tool-receiving cavity, and a pair of elongated generally vertically extending legs that are adapted to be snugly slipped into a pair of generally vertically extending pockets on the tool carrier.

Multiple accessory tool holders may be provided, in sizes and shapes adapted to carry a wide variety of tools, i.e., with suitable tool-supporting surfaces and tool receiving cavities, but with similarly sized and spaced legs adapted to be snugly received into the same or similarly sized and spaced sets of pockets. This enables the use of a single set of pockets to alternately carry a wide variety of tools.

Advantageously, the accessory tool holder can be adapted for carrying additional tools of the type typically carried in the pockets, as well as tools that are not suitable or convenient for holding in pockets.

Accordingly, one preferred tool carrier includes at least one pair of relatively snug pockets sized and spaced for receiving the legs of the accessory tool holders, and thus for carrying a wide variety of tools.

Figure 1:
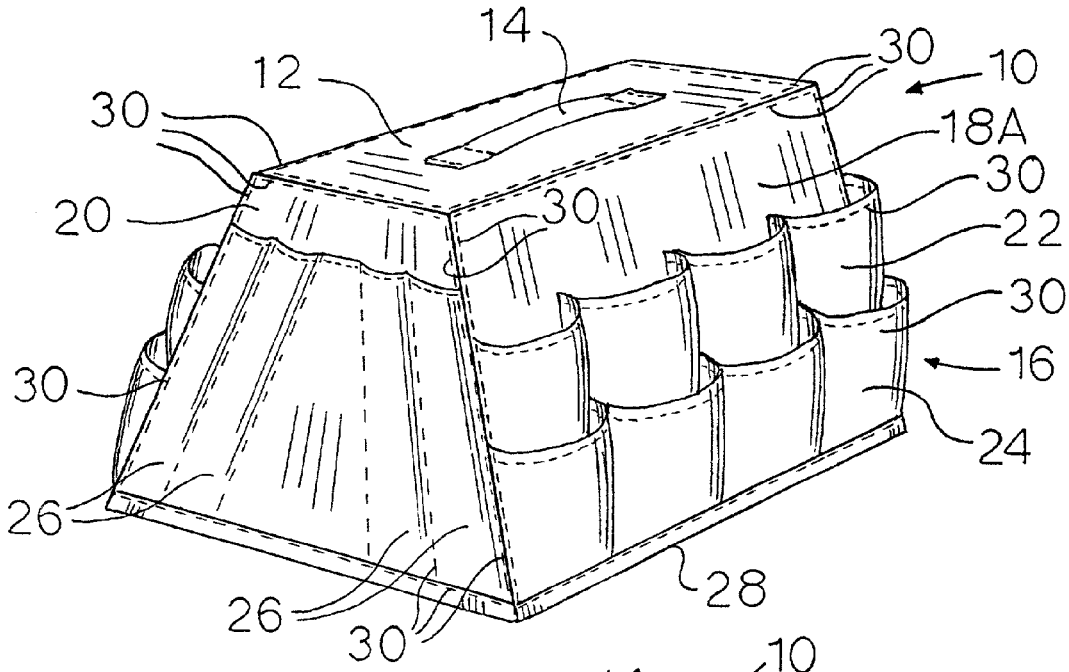
FIG. 1 is a left-front perspective view of a new and improved tool carrier in accordance with and incorporating certain unique aspects of the present invention.
Figure 2:
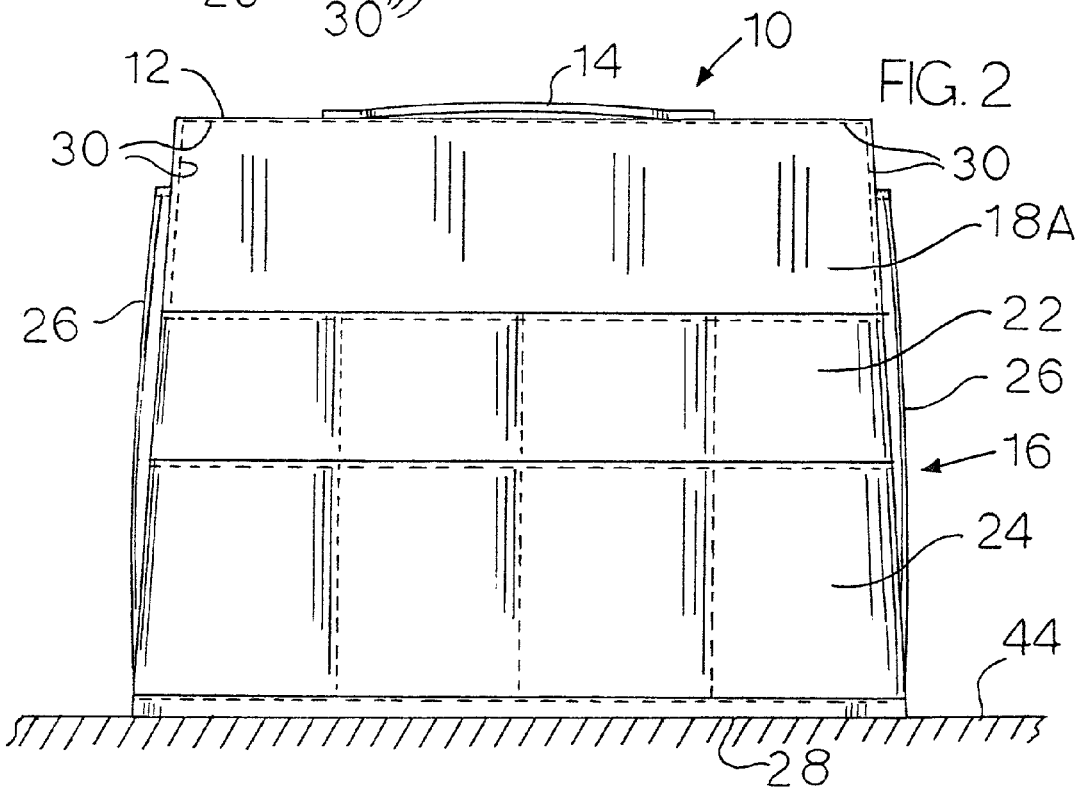
FIG. 2 is front view of the tool carrier of FIG. 1.
Figure 3:
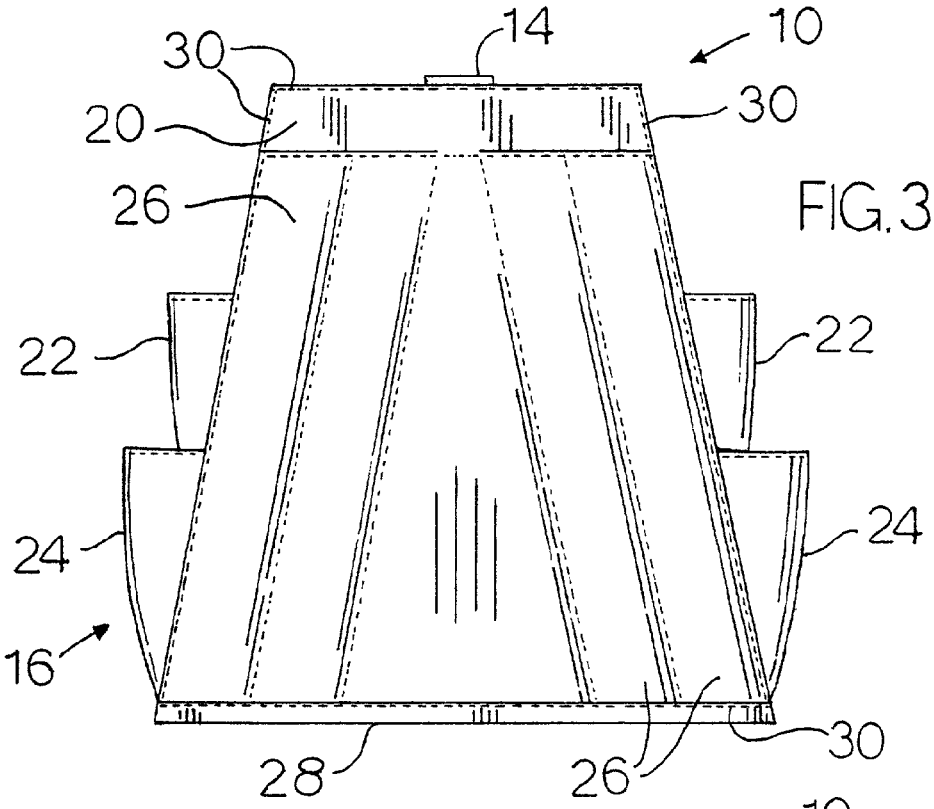
FIG. 3 is left side view of the tool carrier of FIG. 1, the right side view being a mirror image thereof.
Figure 4:
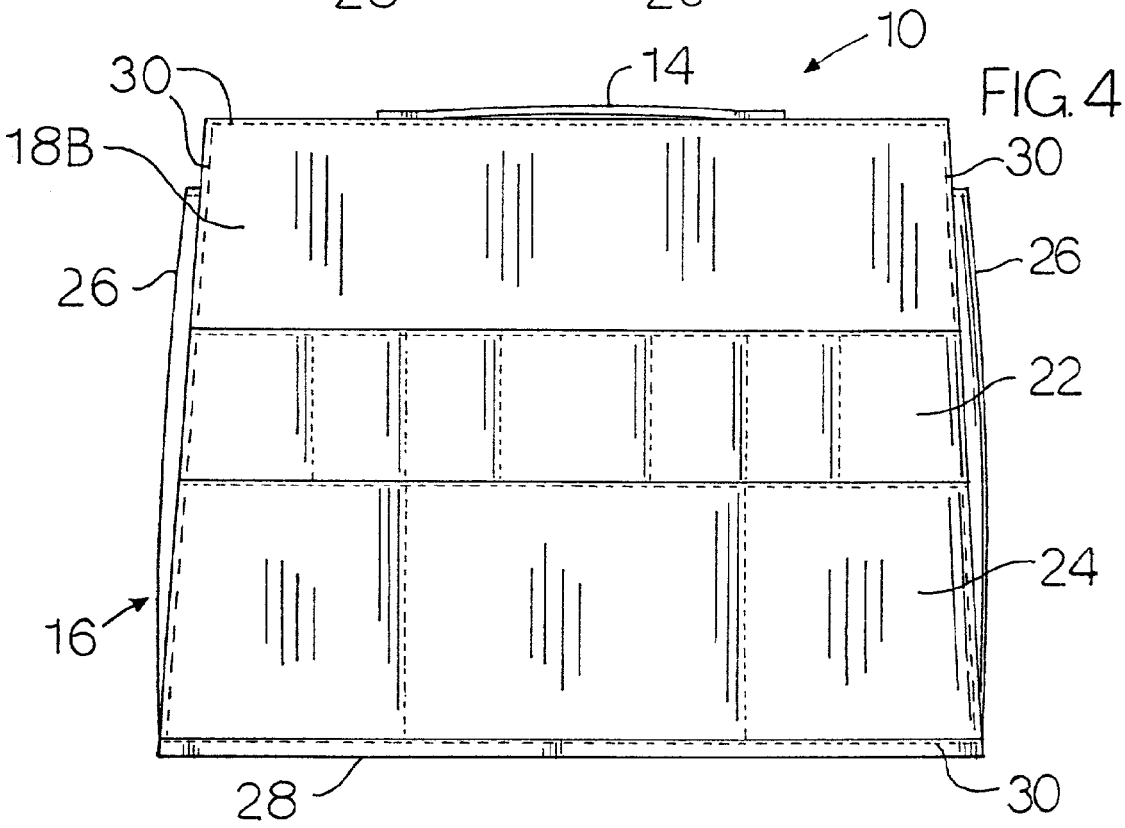
FIG. 4 is a rear view of the tool carrier of FIG. 1.
Figure 5:
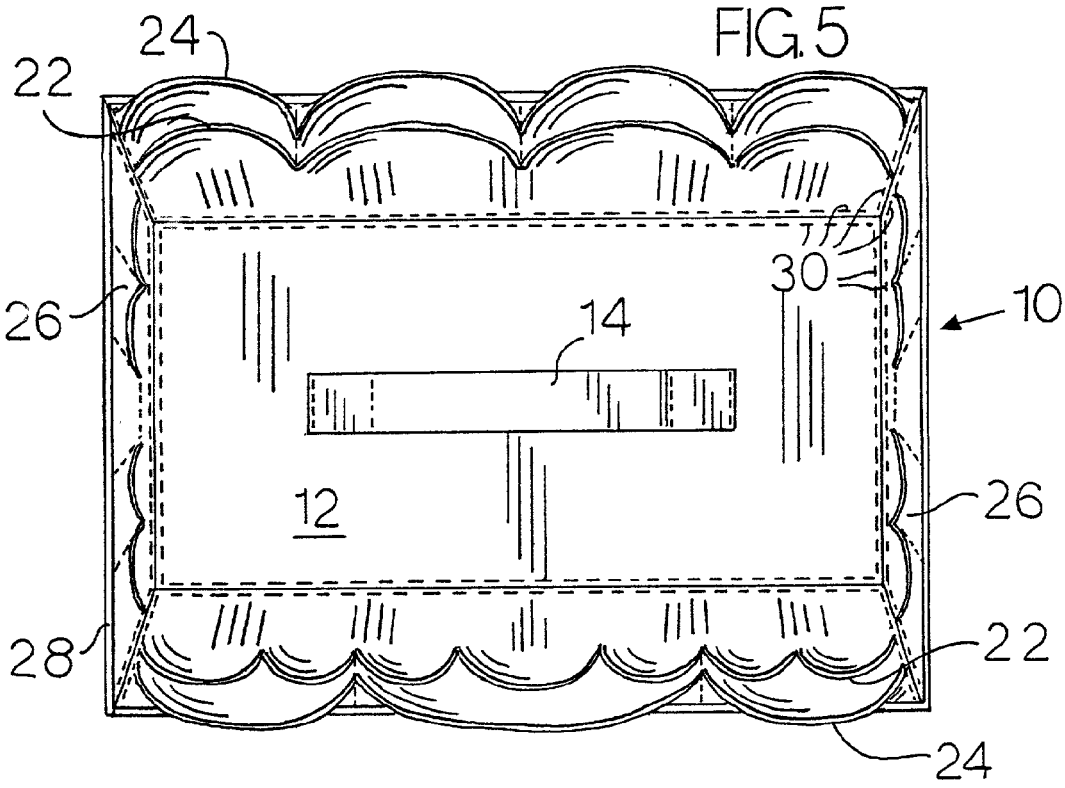
FIG. 5 is a top view of the tool carrier of FIG. 1.
Figure 6:
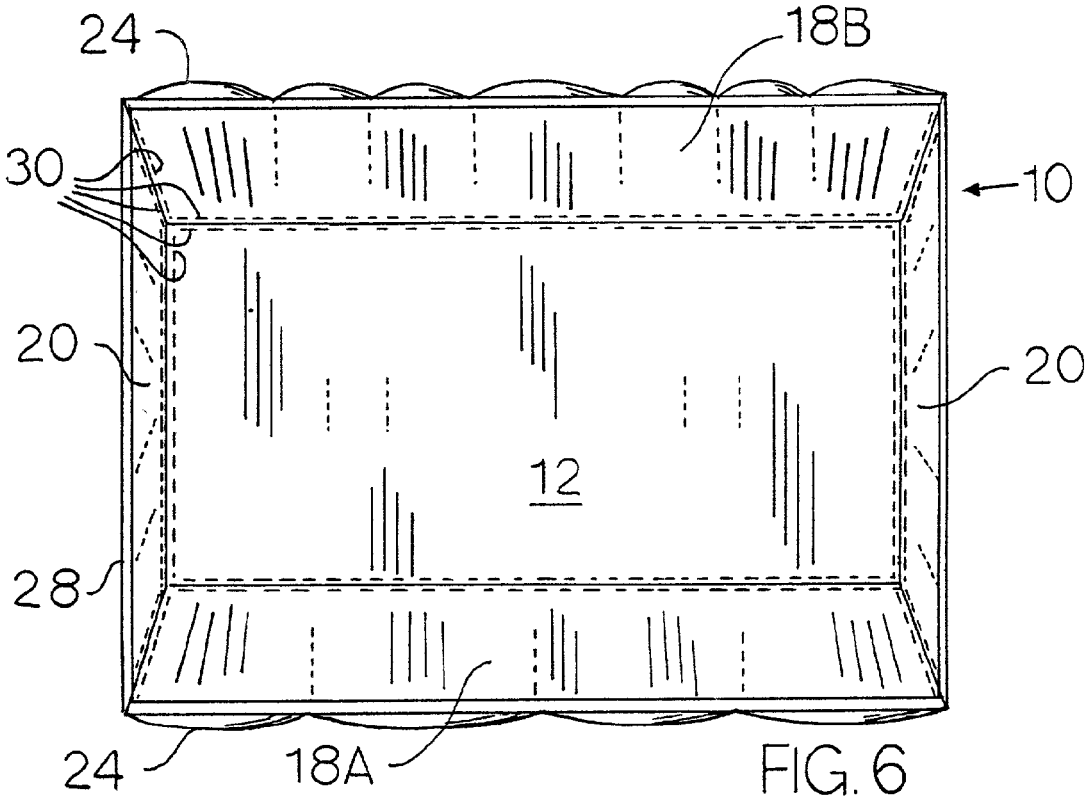
FIG. 6 is a bottom view of the tool carrier of FIG. 1.
Figure 7:
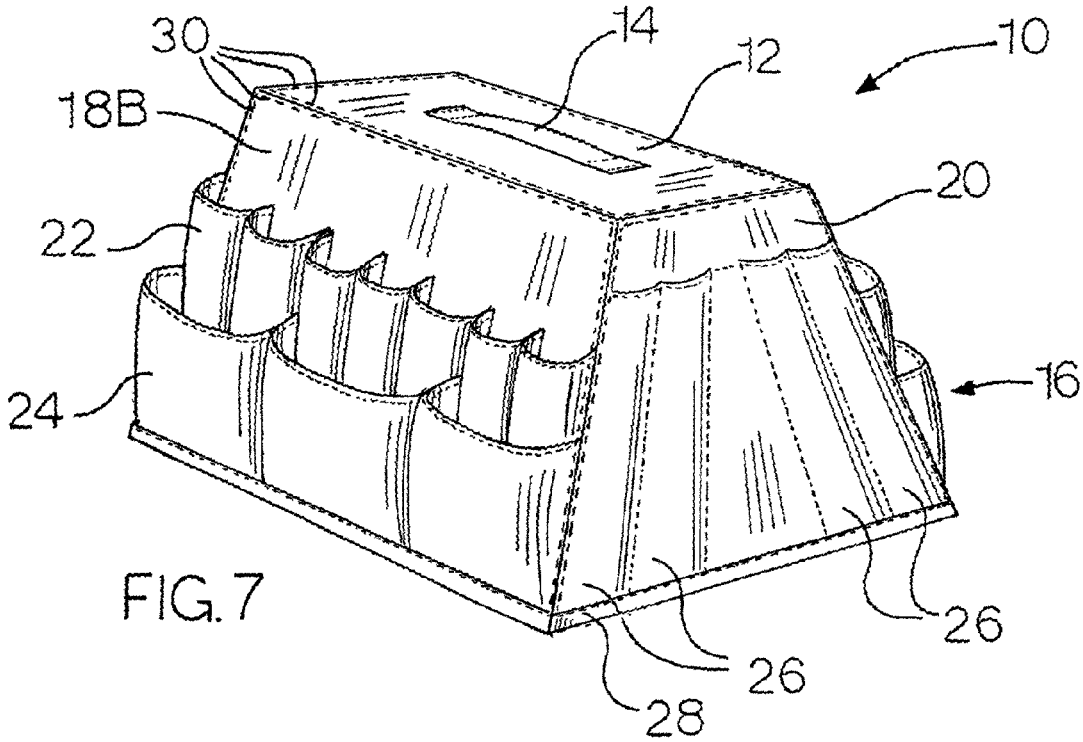
FIG. 7 is a right-rear perspective view of the tool carrier of FIG. 1.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

For purposes of illustration, one embodiment of a preferred tool carrier according to the present invention is shown in the drawings as tool carrier 10 in FIGS. 1–7.

Figure 8:
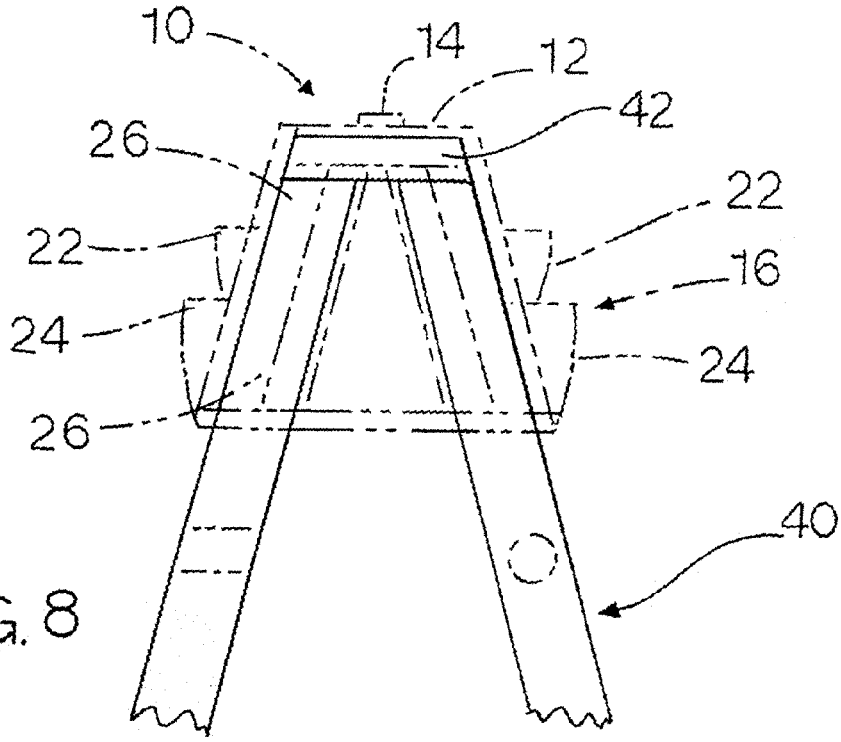
FIG. 8 is a left side view of the upper portion of a step ladder, and showing the tool carrier of FIG. 1 in dashed lines in position thereon.
Figure 9:
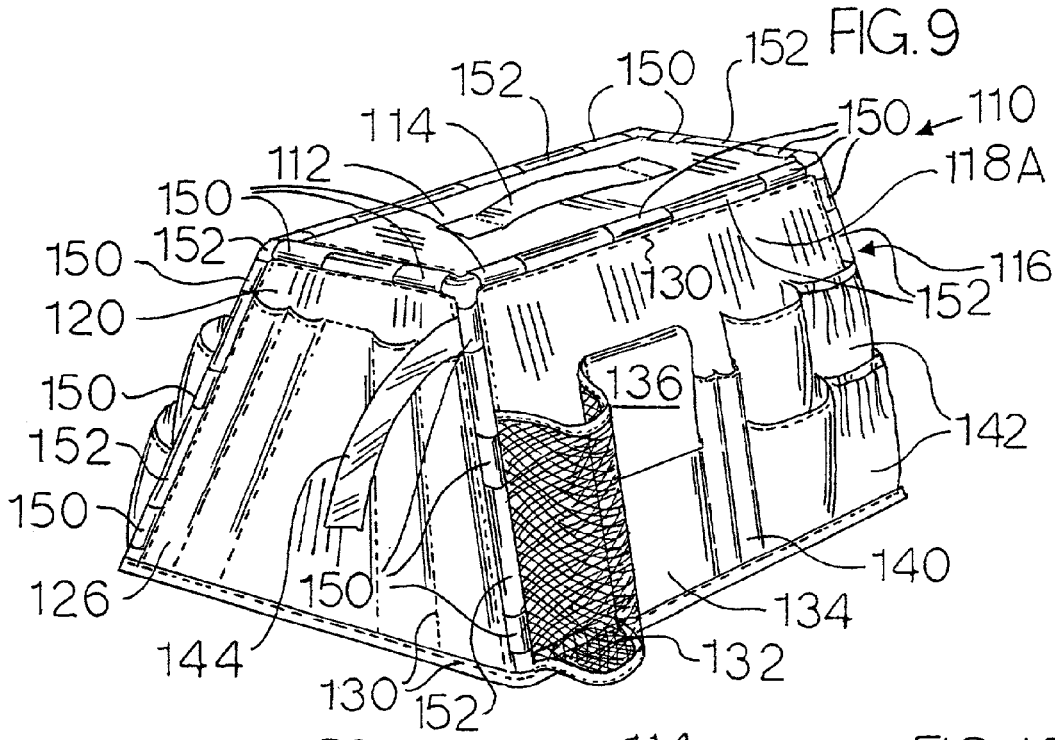
FIG. 9 is a left-front perspective view of the preferred embodiment tool carrier in accordance with the present invention.
Figure 10:
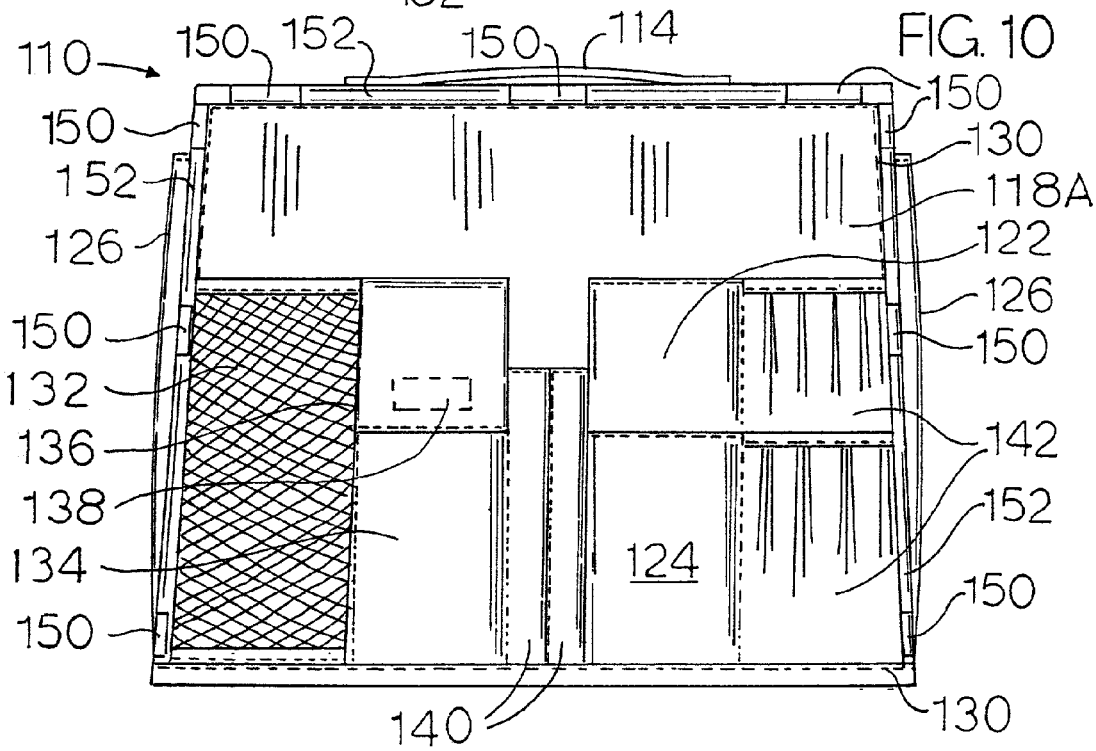
FIG. 10 is a front view of the tool carrier of FIG. 9.
Figure 11:
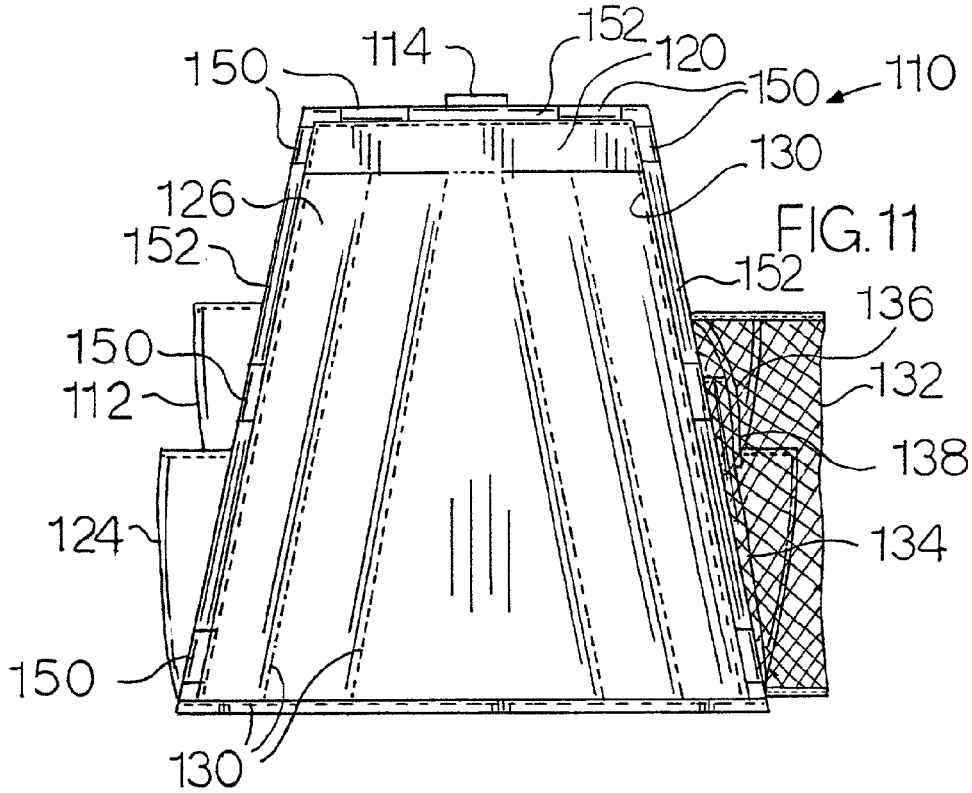
FIG. 11 is left side view of the tool carrier of FIG. 9.
Figure 12:
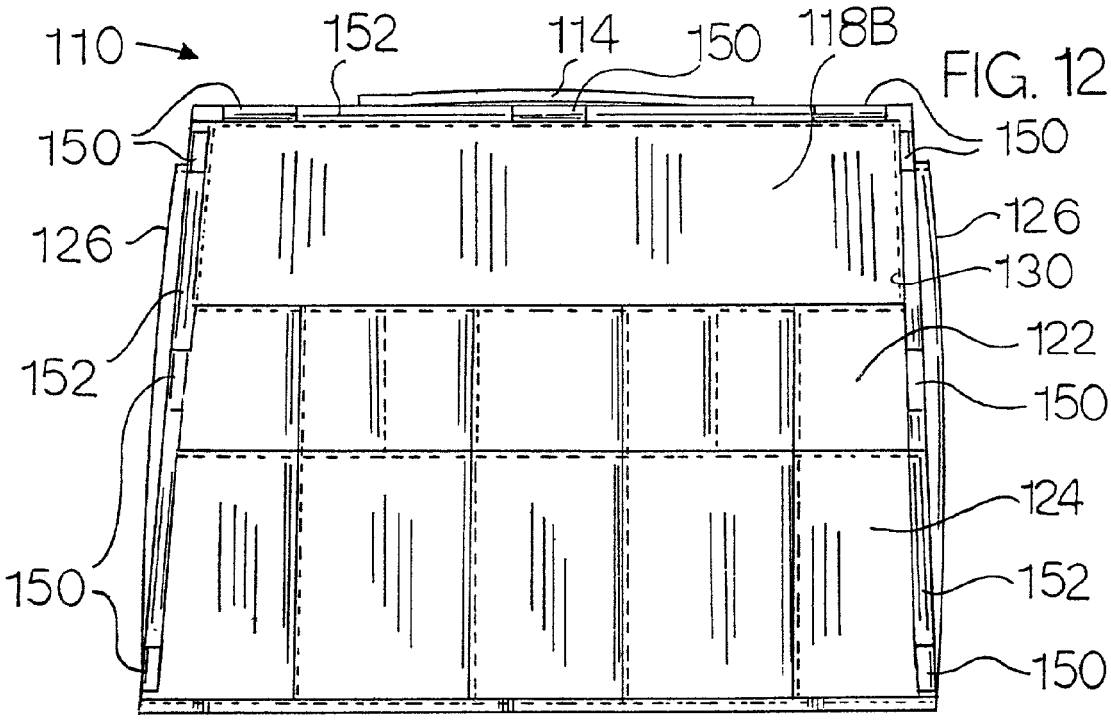
FIG. 12 is a rear view of the tool carrier of FIG. 9.
Figure 13:
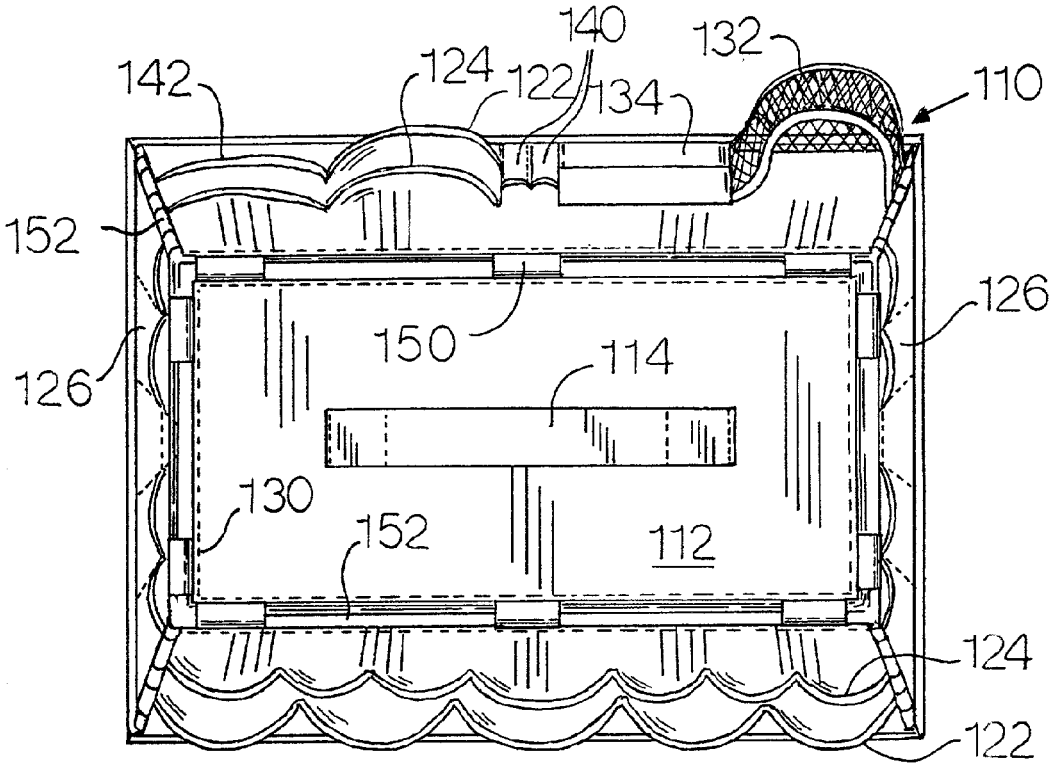
FIG. 13 is a top view of the tool carrier of FIG. 9.
Figure 14:
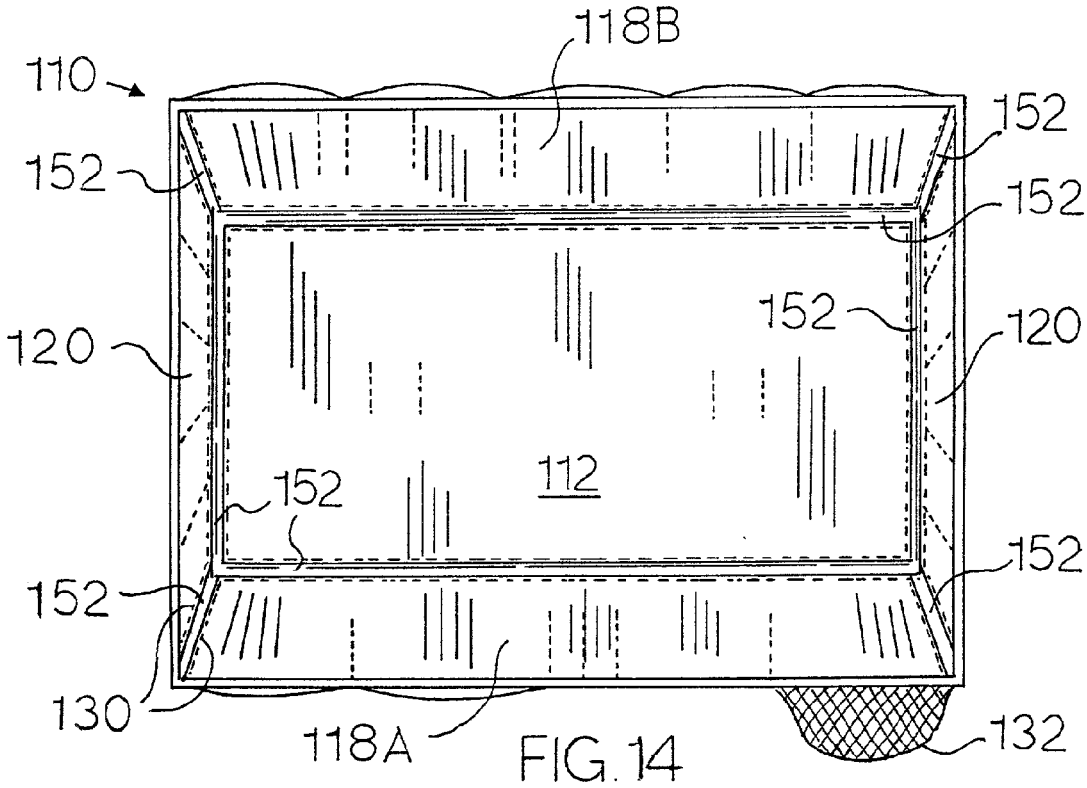
FIG. 14 is a bottom view of the tool carrier of FIG. 9.
Figure 15:
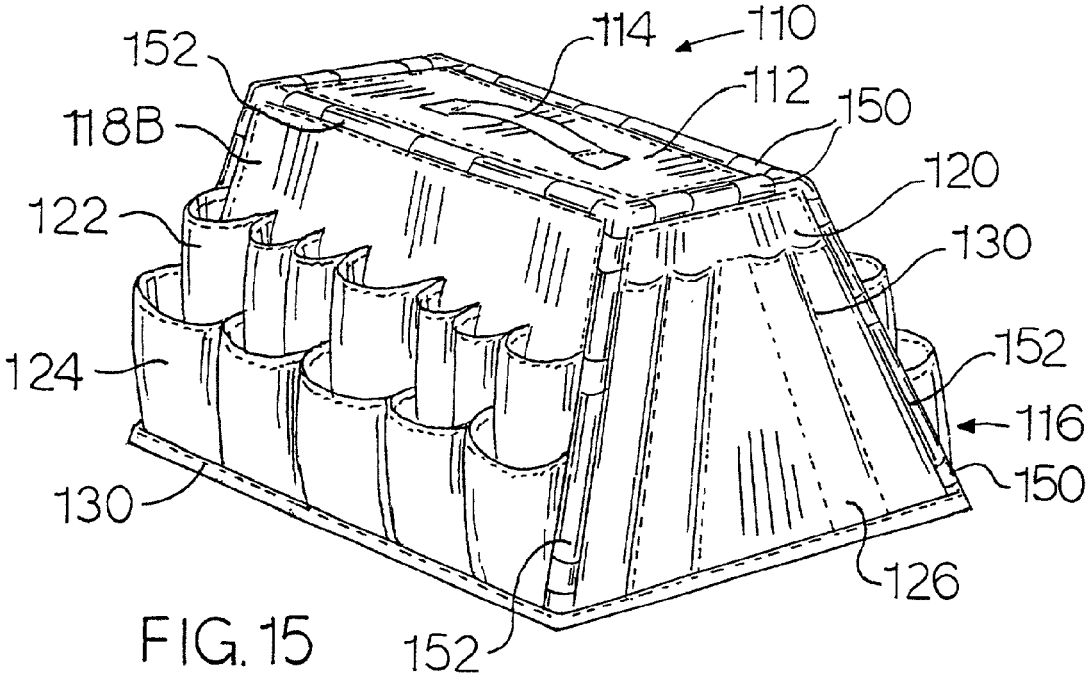
FIG. 15 is a right-rear perspective view of the tool carrier of FIG. 9.

In accordance with the present invention, the tool carrier 10 is uniquely adapted for carrying tools at the top of a folding step ladder 40 (FIG. 8), for alternately carrying tools in a free-standing position on a horizontal surface 44 such as a work bench, table, or shelf, and for ease of transport therebetween. More particularly, the tool carrier 10 is adapted to slip over and be supported by the top step 42 of the step ladder for carrying tools within easy reach while working on the ladder, and to stand upright and retain its shape when placed on a horizontal surface to support the tools carried thereon, and when carried therebetween. As a result, the tool carrier 10 is uniquely adapted for alternate uses, including ease of installation onto and removal from the top step of the ladder, for availability of the tools at other locations, and for storage of the tools between use.

In general, the tool carrier 10 includes a generally planar top panel 12, a skirt 16 depending downwardly from the perimeter of the top panel, a handle 14 connected into position above the top panel, and pockets or pouches for holding tools. The top panel is sized to rest on the top step 42 of the step ladder 40, and the skirt is sized to slip downwardly over and generally embrace the upper portion of the step ladder, with relatively little to no sideways or front-to-back free movement. For alternately holding tools on a horizontal surface 44, the skirt is preferably of a relatively stiff or semi-rigid nature, and is provided with lower edge supports that are spaced both laterally and front-to-back, and that are provided at a constant distance below the plane of the top panel.

The skirt 16 includes a front panel 18*a*, a back panel 18*b*, and side panels 20 interconnected between the front and back panels. The front, back and side panels of the skirt are connected to and extend downwardly from associated front, back and side portions of the top panel 12, and are shaped in conformance with the front, back and sides of the upper portion of the step ladder. For supporting the tool carrier 10 on a horizontal surface 44, the generally planar front, back and side panels are each provided with lower edge portions that extend parallel to the plane of the top panel. Preferably, these lower edge portions extend continuously between the interconnected adjacent panels. This continuous flat base at the open bottom of the skirt provides for maximum footprint engaging the horizontal surface 44 when positioned thereon for supporting the filled tool carrier. Alternately, for example, lower scalloped supporting edge portions may be provided in the skirt panels to establish the laterally and front-to-back spaced supports at the lower perimeter of the skirt.

For use with a conventional folding step ladder 40, the preferred top panel 12 is rectangular to conform to the rectangular shape of the conventional top step 42, the preferred front and back panels 18*a* and 18*b* are generally rectangular to slightly trapezoidal (see e.g., FIGS. 2 and 4) to conform to the front and back profile of the upper portion of the step ladder (the width or the conventional folding step ladder narrows slightly upon progressing toward the top), and the preferred side panels 20 are distinctly trapezoidal (see e.g., FIG. 3) with an decreasing width upon progressing upwardly toward the top panel to conform to the side profile of the upper portion of the conventional folding step ladder.

Hand tools, flashlights, nails, tape, tape measures, cell phones, portable electric tools, drill bits, small levels, files, boxes or screws, spray paint cans, and other desired items such as useful when working on a step ladder (generally designated as "tools" herein) are slidably received and carried in pouches or pockets provided on the skirt 16. The pockets may be of any desired size and configuration for anticipated tools, but are preferably formed with upper edges, defining the opening thereto, at or below the top panel, so as to reduce the likelihood of any given tool extending substantially above the top panel.

In the embodiment shown, the front and back panels 18*a*, 18*b* are provided with outwardly pre-shaped upwardly opening pockets 22 and 24 having upper edges spaced from the skirt for ease of insertion and removal or tools, and the skirt side panels 20 are provide with relatively snug fitting, pairs of elongated parallel pockets 26 adapted to hold relatively narrow tools, and to carry larger-sized tools in tool holders discussed below. Alternately, for example, the side panels may be provided with open pouches similar to pockets 22, 24 or alternate configuration pockets such as also described below.

The handle 14 is sewn, riveted or otherwise secured to either the top panel 12 or the skirt 16 (or, for example, to a frame structure discussed below), into a position for grabbing from above the top panel, and so as to be capable of supporting the weight of the tool carrier and tools therein when carried by the handle.

The tool carrier 10 is made from a durable material suitable for use as contemplated herein. For example, it has been found that certain relatively stiff canvas, leather, and imitation leather materials are suitable for use in constructing the tool carrier, including for supporting the weight of the tools both when positioned on a ladder and when free-standing on a horizontal surface. Canvas fabric is a relatively durable material, and is less costly and more easily sewn together than leather materials. On the other hand, leather is typically more durable than canvas over extended use. When fabricated from such materials, the top, front, back and side panels 12, 18*a*, 18*b* and 20, are preferably interconnected along the length of the adjacent edges, for ease of fabrication, and for maximum shape retention, particularly when the carrier is loaded with tools. Alternately, for example, the tool carrier may be formed from molded plastic. Molded plastic will typically offer the greatest durability of the materials mentioned, and in large quantities, can be manufactured at less cost. However, molded plastic pockets are less flexible for holding tools of different shapes and sizes, and will therefore be less convenient for certain users.

The tool carrier 10 shown in FIGS. 1–7 is made from a relatively stiff, reinforced canvas fabric. In this instance, the top panel 12, the front and back panels 18*a*, 18*b*, and the side panels 20 are formed from pieces of canvas permanently sewn together along respective boundaries as indicated by hem lines 30. The handle 14 is provided in the form of a strap sewn with double stitching near its free ends to the top panel. A continuous lower edge strip 28 is established at the bottom of the skirt by folding and sewing the lower free ends of the canvas panels as shown to close and provide additional edge stiffness to the bottom of the skirt. The front and the back panels are provided with cascading rows of upper pockets 22 and lower pockets 24. The lower pockets extend upwardly from the bottom portion of the skirt to approximately one-third the height of the carrier, and the upper pockets extend from inside the lower pockets, such as from near the lower portion of the skirt, upwardly to approximately two-thirds the height of the carrier.

During fabrication of the tool carrier, the bottom and sides of the pockets 22, 24 and 26 are sewn to the front, back side panels. For the cascading pockets, the upper pockets being first sewn to the panels and the lower pockets being sewn to the panels outwardly of the lower portion of the upper pockets. In preferred fabrication techniques, the pockets 22, 24 and 26 on each panel are formed from a single sheet of pre-cut canvas fabric with the upper hem pre-sewn therein. The bottom of the pockets are first sewn to the panel. The pockets are then one-by-one shaped and sewn along the sides to the panel. Alternately, the pockets may be configured as desired, with certain pockets being specially adapted for specific tools or other specific uses such as discussed further below.

In accordance with another aspect of the invention, unique accessory tool holders, suitable for holding a wide variety of sized and shaped tools, including specific or larger-size tools, are provided for use with the tool carriers. Thus enabling the tool carriers to hold such variety of tools, including tools of a type that are not conveniently held in pockets thereof.

In general, accessory tool holders in accordance herewith are provided with a shoulder or surface having a generally upwardly facing component (when positioned into a tool holding operative position) for supporting the desired tool, and a pair of elongated, parallel, generally vertically extending legs sized and shaped to be slidably but snugly received into a pair of elongated, parallel, generally vertically extending pockets provided in the tool carrier. In preferred embodiments, the accessory tool holder is provided a generally tubular structure, or a substantially closed structure when viewed in cross-section, that includes or defines a vertically extending cavity adapted to receive the tools.

Figure 22:
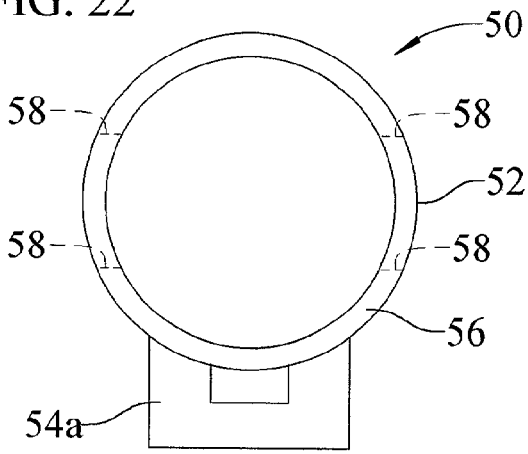
FIG. 22 is a top view of the tool holder shown in FIG. 20.
Figure 21:
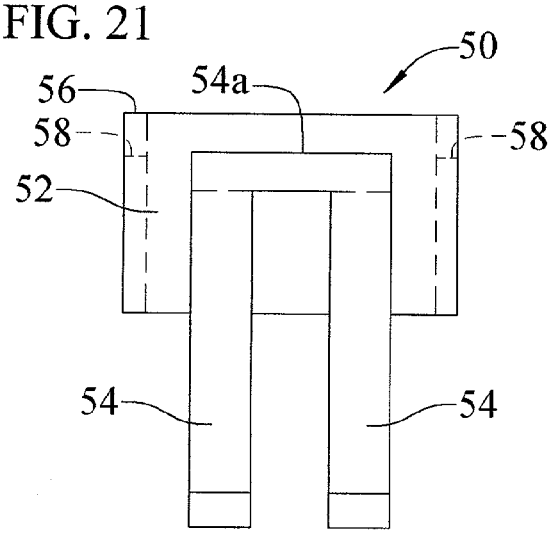
FIG. 21 is a side view of the tool holder shown in FIG. 20.
Figure 20:
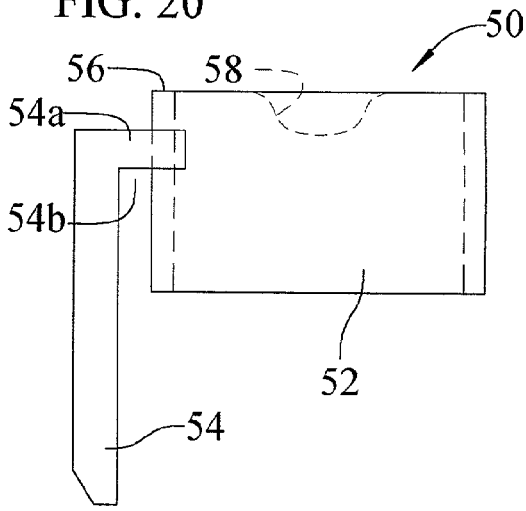
FIG. 20 is a front view of an open-bottom accessory tool holder in accordance herewith and adapted for use with the tool carriers of FIGS. 1 and 9.

One embodiment accessory tool holder in accordance herewith is shown in FIGS. 20–22 as ring tool holder 50. The tool holder 50 includes an open ring 52 and a pair of elongated legs 54 extending generally downwardly from the ring 52. The ring is oriented with its axis extending vertically, to establish open upper and lower ends defining a generally vertically extending cavity therebetween, and an upwardly facing upper surface 56. In this instance, the legs 54 are sized and spaced to fit snugly into a pair of adjacent pockets 26 of the tool carrier 10, and are radially spaced from the outside perimeter of the ring 52 with a connecting portion 54*a* to define a longitudinally extending slot 54*b* therebetween.

Use of the accessory tool holder 50 is accomplished by orienting the legs 54 aligned with the pockets 26, with the ring 52 oriented outwardly of the tool carrier 10, and sliding the legs downwardly into the pockets until the upper portion of the pockets are firmly engage in the connecting portion 54*a* (i.e., the top of the slot 54*b*).

With this arrangement, the open-ring tool holder 50, and thus the tool carrier, is capable of carrying tools of a type that include a shoulder sized to rest on the top surface 56 of the ring and an elongated portion that extends down through center of the ring, and potentially through the open bottom, such as a hammer, a crow bar, or a portable electric hand-drill.

Figure 25:
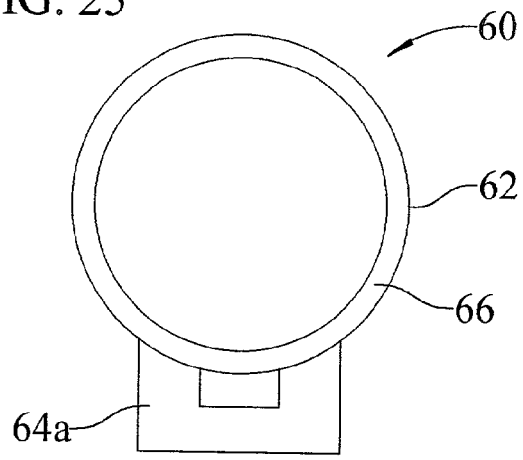
FIG. 25 is a top view of the tool holder shown in FIG. 23.
Figure 24:
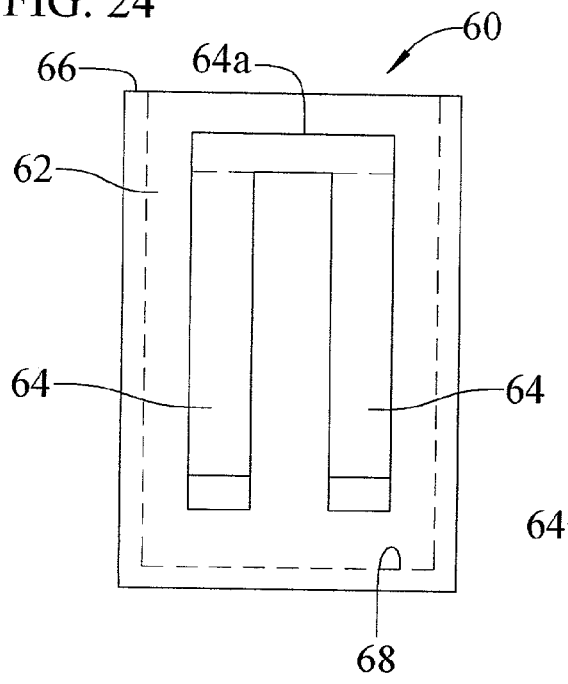
FIG. 24 is a side view of the tool holder shown in FIG. 23.
Figure 23:
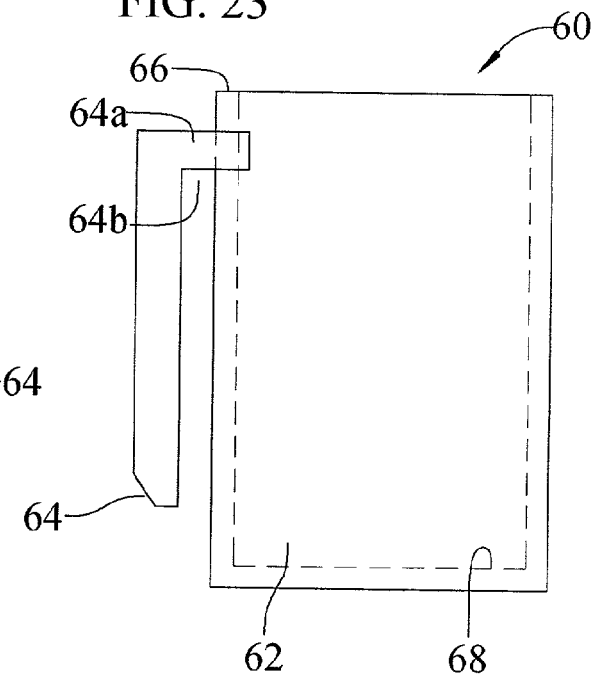
FIG. 23 is a front view of a closed-bottom accessory tool holder in accordance herewith and adapted for use with the tool carriers of FIGS. 1 and 9.

An alternate accessory tool holder 60 is shown in FIGS. 23–25. The tool holder 60 includes a ring 62 having one end open and one end closed, and a pair of elongated legs 64 extending generally downwardly from the ring 62. The ring 62 is oriented with its axis extending vertically, to establish an open upper end and a closed bottom 68 defining a generally vertically extending closed-bottom cavity therebetween, and an upwardly facing upper surface 66. The legs are sized and spaced to fit snugly into a pair of adjacent pockets 26 of the tool carrier 10, and are radially spaced from the outside perimeter of the ring 62 with a connecting portion 64*a* to define a longitudinally extending slot 64*b* therebetween. Use of tool holder 60 is accomplished in a manner similar to use of tool holder 50 described above. With this arrangement, the closed-ring tool holder 60, and thus the tool carrier, is capable of carrying elongated tools adapted to set on the tool-supporting bottom 68, such as long nails, a butane tank and other articles too large and/or too numerous to fit into the pockets 22 and 24, as well as certain tools having shoulders sized to rest on the upper surface 66 and extend downwardly into the closed-bottom cavity.

Although the bottom 68 of the tool holder 60 is shown solid, it will be appreciated that a semi-closed bottom, such as established with a wire-mesh, is also suitable for holding tools therein. It will also be appreciated that the tubular cross-section of the accessory tool holders in accordance herewith need not be round as shown, but may be of any desired cross-sectional shape, and that the upwardly facing tool-supporting surface need not extend horizontally straight as shown, but may include a curvature with a vertical component to define a supporting surface shaped complimentary to associated curvature or shoulders on specific tools. For example, the open-ring tool holder 50 may be provided with optional cutouts, or a shaped upper curvature as generally indicated by the dashed lines 58 in FIGS. 20–23, to receive the head and claw of a hammer therein, and thus provide automatic orientation of the hammer in the tool holder, or the closed bottom of tool holder 60 may be shaped as desired.

Alternately shaped and configured accessory tools holders that are equally suitable for use with snug pockets of the tool carrier will be apparent to those of ordinary skill in the art, including other specially shaped holders for specific tools.

From the foregoing, is will also be readily appreciated that accessory tool holders in accordance herewith, such as accessory tool holders 50 and 60, are interchangeable with regard to use in the tool carrier 10, including in the same set of pockets 26. Accordingly, one accessory tool holder may be selected and used in the tool carrier for certain purposes at certain times, and a different accessory tool holder may be selected and used for other purposes at other times.

In accordance herewith, a preferred tool carrier is provided with pairs of parallel, generally vertically extending, elongated pockets adapted to snugly receive and hold the legs of the accessory tool holders. In the embodiment shown, such pockets are provided for with pockets 26 on the side panels.

For purposes of carrying out this aspect of the invention, the tool carrier may be alternately provided with a pair of upper straps and a pair of lower straps spaced for holding the upper and lower portion of the legs of the accessory tool holder snugly against the skirt. With such arrangement, the upper and lower straps correspond to the upper and lower portions of the pockets 26, respectively, to provide stable upper and lower support for the legs of the accessory tool holders.

The preferred embodiment tool carrier in accordance with the invention is shown as tool carrier 110 in FIGS. 9–15. In construction similar to tool carrier 10, the tool carrier 110 is fabricated from canvas fabric or similar material, with a rectangular top panel 112, and a skirt 116 comprising trapezoidal front, back and side panels 118*a*, 118*b* and 120, respectively, extending downwardly from the associated perimeter portions of the top panel, and sewn together at hem lines generally designated as reference numeral 130 along adjacent edges thereof. A handle 114 is sewn to the top panel, and the skirt is provided with cascading pockets 122 and 124 of various sizes, pairs of elongated, relatively snug side pockets 126 for use with accessory tool holders discussed above, and additional pockets adapted for other specific purposes to receive and hold desired tools.

In this instance, the tool carrier 110 is provided with an expandable mesh pocket 132 preferably with an elastic upper perimeter suitable for carrying, for example, a water or thermos bottle, a pocket 134 with a flap cover 136 releasably securable to the front of the pocket such as with a snap (not shown) or complimentary hook and loop fastening patches 138, pockets 140 sized for carrying pencils and other slender tools, and cascading pockets 142 having elastic sewn into the upper edges for a snug fit around the tools positioned therein.

Available design freedom for providing alternate tool holding apparatus connected to either the skirt or the top panel is also illustrated with the strap 144 extending from one corner of the tool carrier 110. In this instance, the free end of the strap is provided with, for example, a tool carrying accessory such as a hook for hanging a flashlight or other articles equipped with a hook-receiving member, a rod adapted to releasably carry, for example a roll of electrical tape, or complimentary hook or loop patch at each end for looping the strip around a tool.

In accordance with yet another aspect of the invention, the tool carrier 110 is uniquely adapted for resilient expansion and contraction. More particularly, the panels 112, 118*a*, 118*b* and 120 of the tool carrier are elastically connected for independent movement with respect to one another for expansion and contraction of the skirt. Advantageously, this promotes a snug fit on the step ladder 40, and assists in snugly fitting on step ladders of different sizes.

In carrying out this aspect of the invention, elastic members in the form of bands 150 are secured between the edge portions of adjacent top, front, back and side panels 112, 118*a*, 118*b* and 120. In preferred embodiments, the adjacent edges of the panels are sewn or otherwise connected together, and the elastic bands 150 are sewn between adjacent panels so as to establish folded material portions 152 extending between and along the length of the adjacent panels when the bands are in a relaxed (i.e., unstretched) condition as shown in detail in FIG. 18. In this instance, the folded material portions 152 are additional strips that are sewn between the edges of the adjacent panels. As the elastic bands stretch, the folded material portions 152 straighten, as shown in detail in FIG. 19, increasing the size of the carrier. With this arrangement, as the tool carrier is slipped over the top step of the ladder, and the insides of the panels can engage the upper portion of the ladder, causing the panels to expand outwardly for a snug fit on the ladder. Advantageously, the folded material portions 152 provide a limit to the length the elastic bands can be stretched, thus preventing the elastic bands from being stretched beyond their normal elastic limit, as well as the eliminate space between the panels to prevent small articles from falling therethrough. It is noted that the bottom corners of the skirt 116 is shown in the drawings as fully expanded as positioned on a ladder. Thus the corners are presented with squared appearance in the drawings. However, when the tool carrier is not on a ladder, the bottom corners will fold in along with the remainder of the associated folded material portions 152.

In accordance with still another aspect of the invention, the tool carrier 110 includes an expandable frame structure 160 adapted to provide enhanced rigidity, to assist in maintaining the shape of the skirt, and supporting the weight of the tools, particularly when the carrier is filled with tools and either being carried or free-standing, as well as during expansion and contraction of the skirt during installation onto and removal from the step ladder.

In carrying out this aspect of the invention, an expandable frame is preferably connected to at least either the front and back panels or the side panels to provide tool-supporting rigidity to the skirt, and includes lower perimeter portions spaced laterally and front-to-back for or adapted to assist in supporting the tool carrier in a free-standing position on a horizontal surface.

Figure 16:
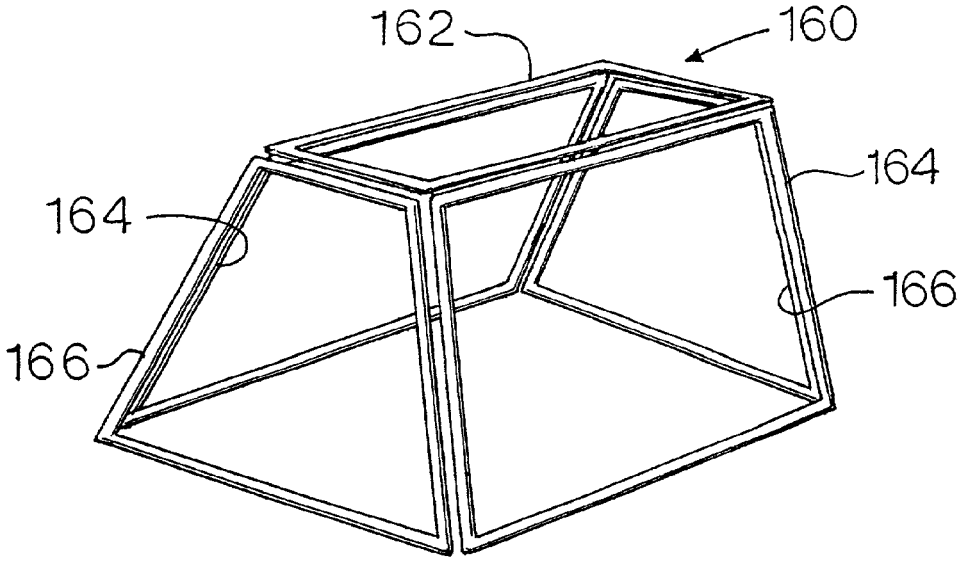
FIG. 16 is a left-front perspective view of an internal supporting frame structure of the tool carrier of FIG. 9.
Figure 17:
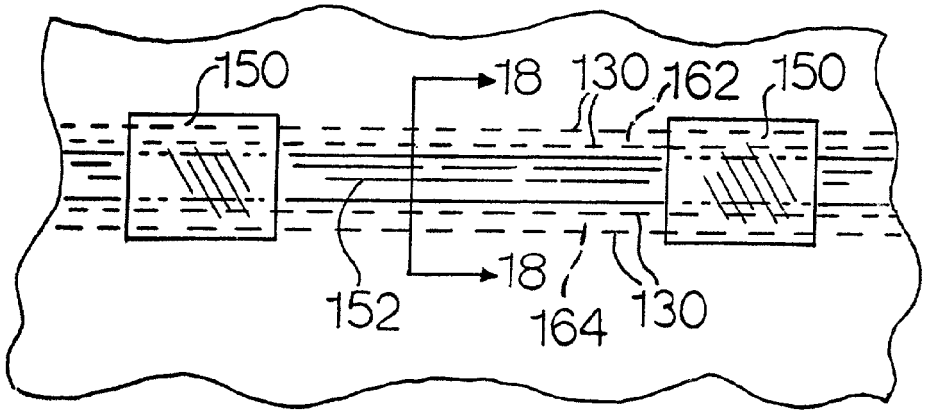
FIG. 17 is an enlarged fragmentary view of a certain portion of the tool carrier shown in FIG. 9.

For use in the expandable tool carrier 110, a preferred expandable frame structure 160 includes independent frame members associated with and connected to each of the top 112, front and back 118*a*, 118*b*, and side 120 panels. In this instance, a preferred frame structure includes a top frame member 162, front and back frame members 164 and side frame members 166, such as illustrated in FIG. 16 as in their normal position when connected to the top panel and skirt (not shown in FIG. 16).

Figure 18:
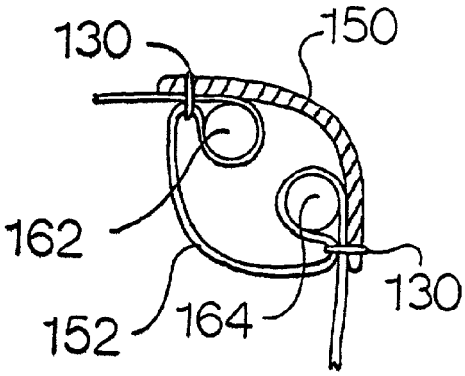
FIG. 18 is a fragmentary cross-sectional view taken substantially along the line 18—18 of FIG. 17.
Figure 19:
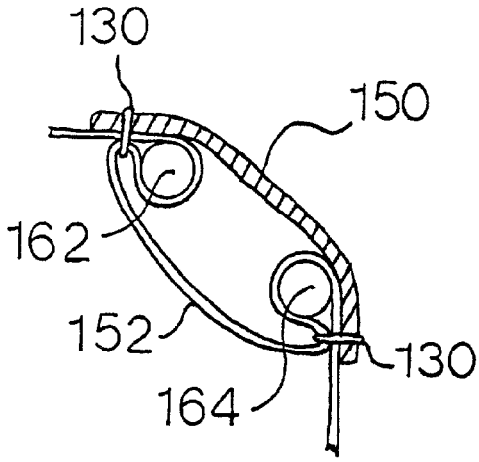
FIG. 19 is a view similar to FIG. 18 but showing the tool carrier panels expanded from one another.

To provide maximum support, the top frame members is preferably rectangular as shown, and the front, back side frame members are trapezoidal, tracking the shape of the associated panels. The frame members are further preferably sized at or just slightly smaller than the associated panels such that the frame members are secured in position along the edges of the panels, preferably with the canvas panel edges circled around the frame members so the frame members are not exposed, and such that the frame members are generally encased in and effectively a part of the associated panels. With this arrangement, the frame members 162, 164 and 166 expand and contract coincident with the associated panels, such as indicated in FIGS. 18–19, and the tool carrier rests on the bottom legs of the front, back and side frame members 164 and 166 when positioned upright on a horizontal surface, with only the thickness of the panel canvas therebetween. Advantageously, the expandable frame 160 permits the panels to be fabricated from relatively flexible material.

In an alternate construction embodiment (not shown) of an expandable tool carrier, the panels are constructed from two pieces of canvas, with the associated frame members held in position therebetween with the two pieces sewn together. Adjacent edges of the panels are then interconnected as discussed above.

In view of the disclosure hereof, those skilled in the art will understand and appreciate that additional alternate constructions, features, and embodiments may be included with and/or incorporated into a tool carrier hereof without departing from the scope and spirit of the invention.

By way of example only, the non-expandable tool carrier 10 may be provided with additional free-standing toolholding rigidity with a non-expandable frame structure that is appropriately connected to at least either the top panel 12 or the upper portion of the skirt 16. The tool carrier handle device may be provided in a form other than a strap as shown, such a loop or padded ring adapted for lifting and carrying purposes in accordance herewith. An expandable tool carrier similar to carrier 110 may be provided with panels of relatively stiff construction effecting an integral frame so as to eliminate the separate frame structure 160 thereof. And a tool carrier in accordance with the invention may include, for example, additional or specific tool carrying devices such as a strap for a hammer or crow bar, without departing from the advantages achievable with use of the accessory tool holder. These and other modifications and alternate embodiments of the present invention will be evident to those skilled in the art.

Moreover, as used herein, the description of the panel as "rectangular" or "trapezoidal", and identification of the associated perimeters, is not intended to limit the shape of the associated panels to the precise geometric definitions thereof, or to exclude provision of somewhat non-rectangular or trapezoidal panels such as resulting if, for example, (i) a flap is provided extending from a side of the top panel, over and beyond the connection between the top panel and the skirt, such as for lifting or tool-holding purposes, and (ii) scalloped lower edges are provided such as to establish supporting edge portions discussed above for use in supporting the tool carrier as free-standing on a horizontal surface; but is instead intended to identify the operative portions of the panels as discussed in connection therewith.

From the foregoing, it will be apparent that the present invention brings to the art a new and improved tool carrier which is uniquely adapted for convenient use both on and off a step ladder, and a new and improved accessory tool holder adapted for use therewith to enable holding a wide variety of sized and shaped tools.

I claim:

1. A tool carrier configured for resting on the top of a step ladder, the tool carrier comprising:

a) a generally rectangular top panel;

b) a skirt having planar front and back panels and trapezoidal side panels extending downwardly from respective portions of the top panel, the edge portions of the adjacent panels being interconnected with one another, the front, back and side panels having lower edges at equal distance below the top panel for supporting the tool carrier in an upright position on a horizontal surface;

c) a handle connected into position above the top panel;

d) a plurality of tool-receiving pockets connected to the skirt; and e) elastic members interconnecting adjacent panels for resilient expansion and contraction therebetween, the elastic members extending across said interconnected edge portions of adjacent panels.

2. The tool carrier as defined in claim 1 in which the lower edges of said front, back and side panels extend continuously between adjacent interconnected panels to define a continuous, generally rectangular lower skirt perimeter at said constant distance from the top panel.

3. The tool carrier as defined in claim 1 further comprising a frame structure connected to at least one of said top panel and an upper portion of said skirt to assist in supporting the tool carrier in an upright position on a horizontal surface.

4. The tool carrier as defined in claim 3 in which said frame structure includes one of (i) front and back frame members, and (ii) side frame members, connected to associated ones of said panels.

5. A tool carrier configured for resting on the top of a step ladder, the tool carrier comprising:

a) a generally rectangular top panel;

b) a semi-rigid skirt depending downwardly from the top panel, the skirt having front, back and side panels cooperative to define a lower perimeter configured to support the tool carrier in an upright position on a horizontal surface, the edge portions of the adjacent panels being interconnected with one another;

c) elastic members further interconnecting all adjacent edges of the panels such that the panels are moveable in relation to one another for resilient expansion and contraction of the skirt, the elastic members extending across said interconnected edge portions of adjacent panels; and d) a plurality of tool-receiving pockets connected to the skirt.

6. The tool carrier as defined in claim 5 further comprising a handle connected into position above the top panel.

7. The tool carrier as defined in claim 5 further comprising a frame structure connected to at least one of said top panel and an upper portion of said skirt to assist in supporting the tool carrier in an upright position on a horizontal surface.

8. The tool carrier as defined in claim 7 in which said frame structure includes one of (i) front and back frame members and (ii) side frame members, connected to associated ones of said panels.

9. A tool carrier configured for positioning on the top of a step ladder, the tool carrier comprising:

a) a generally rectangular top panel, b) a skirt depending downwardly from the top panel, the skirt having planar front and back panels and trapezoidal side panels extending downwardly from respective portions of the top panel, adjacent edge portions of the panels being interconnected with one another;

c) a frame structure connected to at least one of the top panel and the upper portion of the skirt, and having a lower perimeter for supporting the tool carrier in an upright position on a horizontal surface;

d) a plurality of tool-receiving pockets connected to the skirt, and e) elastic members interconnecting adjacent ones of one of (i) said frame members and (ii) said panels such that the frame members and associated panels are moveable together and in relation to adjacent ones of said frame members and associated panels for expansion and contraction of the skirt.

10. The tool carrier as defined in claim 9 further comprising a handle connected into position above the top panel.

11. The tool carrier as defined in claim 9 in which said frame structure includes one of (i) front and back frame members and (ii) side frame members, connected to associated ones of said panels.

12. The tool carrier as defined in claim 11 in which said frame structure includes top, front, back and side frame members connected to associated ones of said panels.

13. The tool carrier as defined in claim 9 further comprising folded material potions connected between adjacent panels.

14. A tool carrier configured for resting on the top of a step ladder, the tool carrier comprising:

a) a generally rectangular top panel;

b) a skirt depending downwardly from the edges of the rectangular top panel, the skirt comprising front and back panels and two opposite trapezoidal side panels extending downwardly from respective front, back and opposite side edge portions of the top panel, adjacent edge portions of the panels being interconnected to one another to establish a generally closed skirt with a lower perimeter configured to support the tool carrier in an upright position on a horizontal surface;

c) a handle connected into position above the top panel;

d) a pair of elongated, generally parallel pockets connected to one of the side panels of the skirt; and e) a removable tool holder with a tool-supporting surface and a pair of elongated, generally parallel legs connected to the tool-supporting surface and slidably but snugly received into the pockets.

15. The tool carrier as defined in claim 14 in which the tool holder includes a ring oriented with its axis extending vertically, and having an open upper end establishing said tool-supporting surface.

16. The tool holder as defined in claim 15 in which the ring is provided with a closed bottom that establishes an alternate tool-supporting surface.

* * * * *